US006454358B1

(12) United States Patent
Benincasa

(10) Patent No.: US 6,454,358 B1
(45) Date of Patent: Sep. 24, 2002

(54) MODULAR CHAIR

(76) Inventor: Michael Benincasa, 5 Canato Pl., Armonk, NY (US) 10504

( * ) Notice: Subject to any disclaimer, the term of this patent is extended or adjusted under 35 U.S.C. 154(b) by 0 days.

(21) Appl. No.: 09/871,793

(22) Filed: Jun. 1, 2001

(51) Int. Cl.[7] ..... A47C 7/00
(52) U.S. Cl. ..... 297/440.14; 297/233
(58) Field of Search ..... 297/118, 233, 297/283.1, 3, 440.14, 440.1, 451.8

(56) References Cited

U.S. PATENT DOCUMENTS 3,606,461 A 9/1971 Moriyama ..... 297/445
3,811,728 A 5/1974 Redemske ..... 297/440
3,973,800 A 8/1976 Kogan ..... 297/440
4,077,666 A * 3/1978 Heumann
4,437,704 A * 3/1984 Hovsepians
5,308,146 A * 5/1994 Chou
5,632,524 A * 5/1997 Ikeda et al.
6,045,193 A * 4/2000 Johnson
6,063,007 A * 5/2000 Sithole

* cited by examiner

*Primary Examiner*—Milton Nelson, Jr.
(74) *Attorney, Agent, or Firm*—Goldstein & Lavas, P.C.

(57) ABSTRACT

A modular chair including a pair of upper components each having a generally U-shaped configuration. Each upper component has a horizontal segment having opposed ends. The opposed ends each have a rounded segment secured thereto and extending upwardly therefrom in an outwardly angular orientation. A pair of lower components are adapted for coupling with the pair of upper components. The pair of lower components each have a generally U-shaped configuration. Each lower component has a horizontal segment having opposed ends. The opposed ends each have a vertical segment extending upwardly therefrom. Each vertical segment has an arcuate recess formed on upper and inner surfaces thereof. The pair of upper components are receivable between the vertical segments whereby the rounded segments are seated within the arcuate recesses and the horizontal segments are in an abutting relationship in a fully assembled configuration.

4 Claims, 4 Drawing Sheets

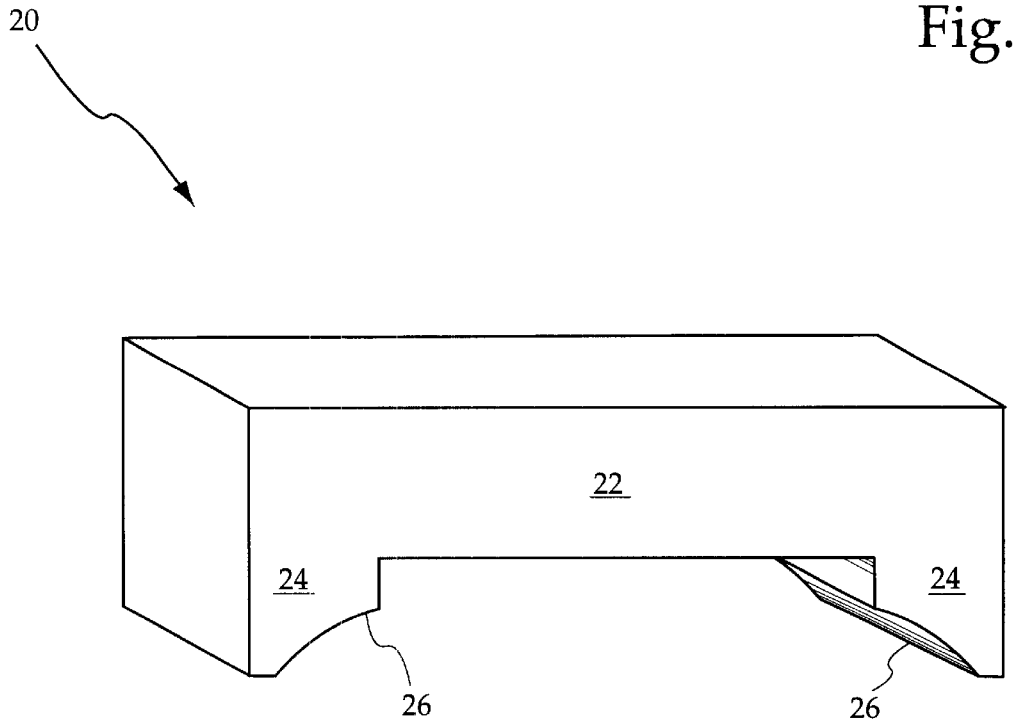
Fig. 4
Fig. 5
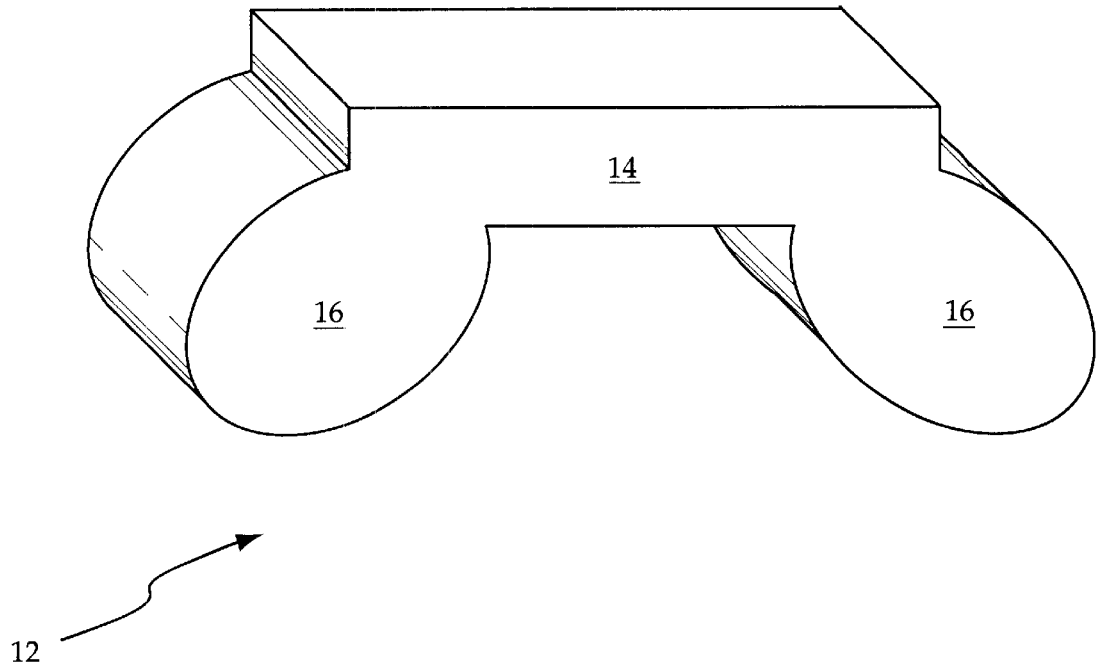

MODULAR CHAIR

BACKGROUND OF THE INVENTION

The present invention relates to a modular chair and more particularly an item of furniture that can be converted into a plurality of furniture components.

The use of furniture devices is known in the prior art. More specifically, furniture devices heretofore devised and utilized for the purpose of assembling into a variety of shapes are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,973,800 to Kogan discloses a piece of furniture comprised of modular units that can be assembled or disassembled. U.S. Pat. No. 3,606,461 to Moriyama and U.S. Pat. No. 3,811,728 to Redemske disclose additional modular furniture assemblies.

While these devices fulfill their respective, particular objective and requirements, the aforementioned patents do not describe a modular chair for being capable of being converted into a plurality of furniture components.

In this respect, the modular chair according to the present invention substantially departs from the conventional concepts and designs of the prior art, and in doing so provides an apparatus primarily developed for the purpose of being capable of being converted into a plurality of furniture components.

Therefore, it can be appreciated that there exists a continuing need for a new and improved modular chair which can be used for being capable of being converted into a plurality of furniture components. In this regard, the present invention substantially fulfills this need.

SUMMARY OF THE INVENTION

In the view of the foregoing disadvantages inherent in the known types of furniture devices now present in the prior art, the present invention provides an improved modular chair. As such, the general purpose of the present invention, which will be described subsequently in greater detail, is to provide a new and improved modular chair which has all the advantages of the prior art and none of the disadvantages.

To attain this, the present invention essentially comprises a pair of upper components each having a generally U-shaped configuration. Each upper component has a horizontal segment having opposed ends. The opposed ends each have a rounded segment secured thereto and extending upwardly therefrom in an outwardly angular orientation. One of the upper components has a back segment extending between the rounded segments thereof. A pair of lower components are adapted for coupling with the pair of upper components. The pair of lower components each have a generally U-shaped configuration. Each lower component has a horizontal segment having opposed ends. The opposed ends each have a vertical segment extending upwardly therefrom. Each vertical segment has an arcuate recess formed on upper and inner surfaces thereof. The pair of upper components are receivable between the vertical segments whereby the rounded segments are seated within the arcuate recesses and the horizontal segments are in an abutting relationship in a fully assembled configuration. The upper and lower components can be separated from one another and inverted to provide four separate seats.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved modular chair which has all the advantages of the prior art furniture devices and none of the disadvantages.

It is another object of the present invention to provide a new and improved modular chair which may be easily and efficiently manufactured and marketed.

It is a further object of the present invention to provide a new and improved modular chair which is of durable and reliable construction.

An even further object of the present invention is to provide a new and improved modular chair which is susceptible of a low cost of manufacture with regard to both materials and labor, and which accordingly is then susceptible of low prices of sale to the consuming public, thereby making such a modular chair economically available to the buying public.

Even still another object of the present invention is to provide a new and improved modular chair for being capable of being converted into a plurality of furniture components.

Lastly, it is an object of the present invention to provide a new and improved modular chair including a pair of upper components each having a generally U-shaped configuration. Each upper component has a horizontal segment having opposed ends. The opposed ends each have a rounded segment secured thereto and extending upwardly therefrom in an outwardly angular orientation. A pair of lower components are adapted for coupling with the pair of upper components. The pair of lower components each have a generally U-shaped configuration. Each lower component has a horizontal segment having opposed ends. The opposed ends each have a vertical segment extending upwardly therefrom. Each vertical segment has an arcuate recess formed on upper and inner surfaces thereof. The pair of upper components are receivable between the vertical segments whereby the rounded segments are seated within the arcuate recesses and the horizontal segments are in an abutting relationship in a fully assembled configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a perspective view of one of the lower components of the present invention.

FIG. 5 is a perspective view of one of the upper components of the present invention.

The same reference numerals refer to the same parts through the various figures.

DESCRIPTION OF THE PREFERRED EMBODIMENT

Figure 1:
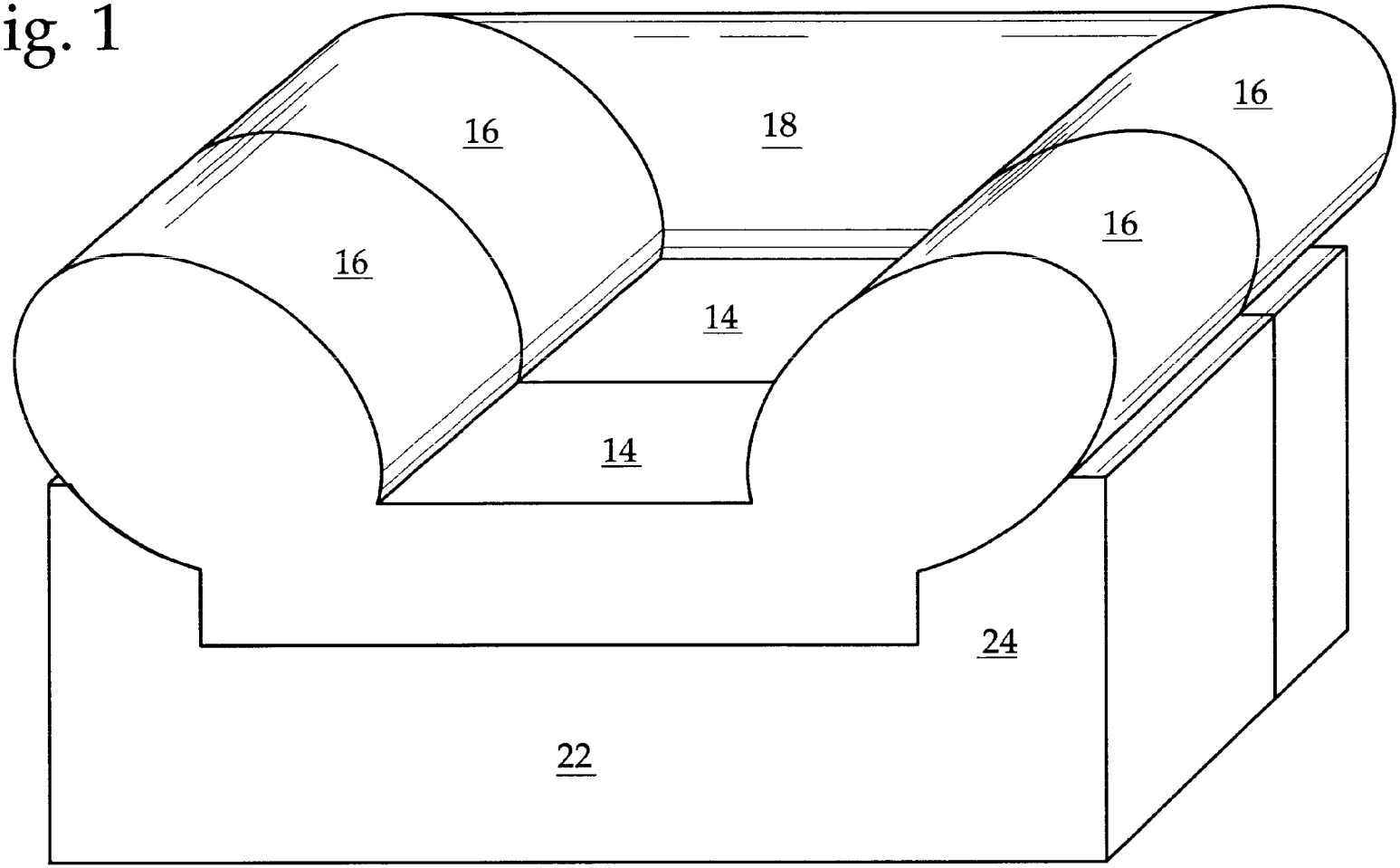
FIG. 1 is a perspective view of the preferred embodiment of the modular chair constructed in accordance with the principles of the present invention.
Figure 2:
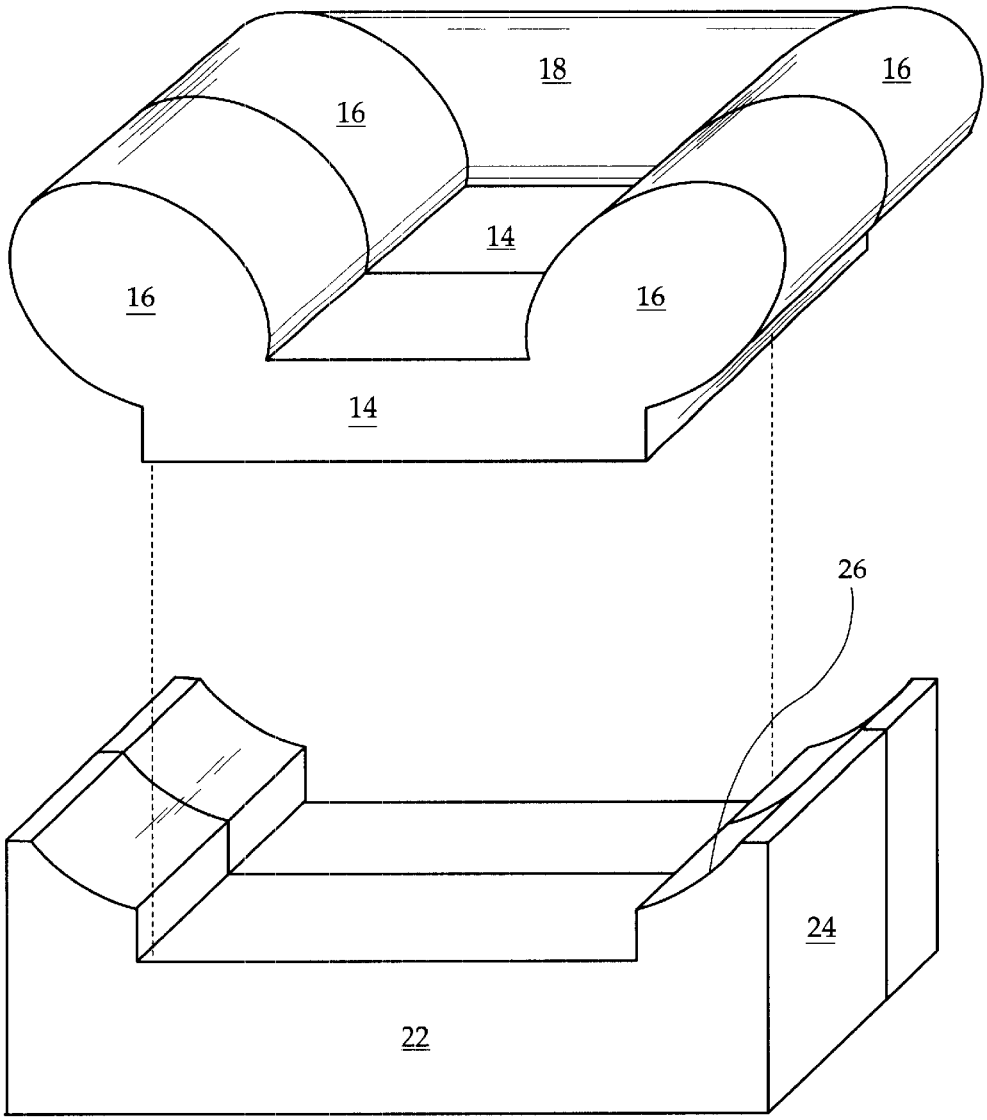
FIG. 2 is a partially exploded perspective view of the present invention.
Figure 3:
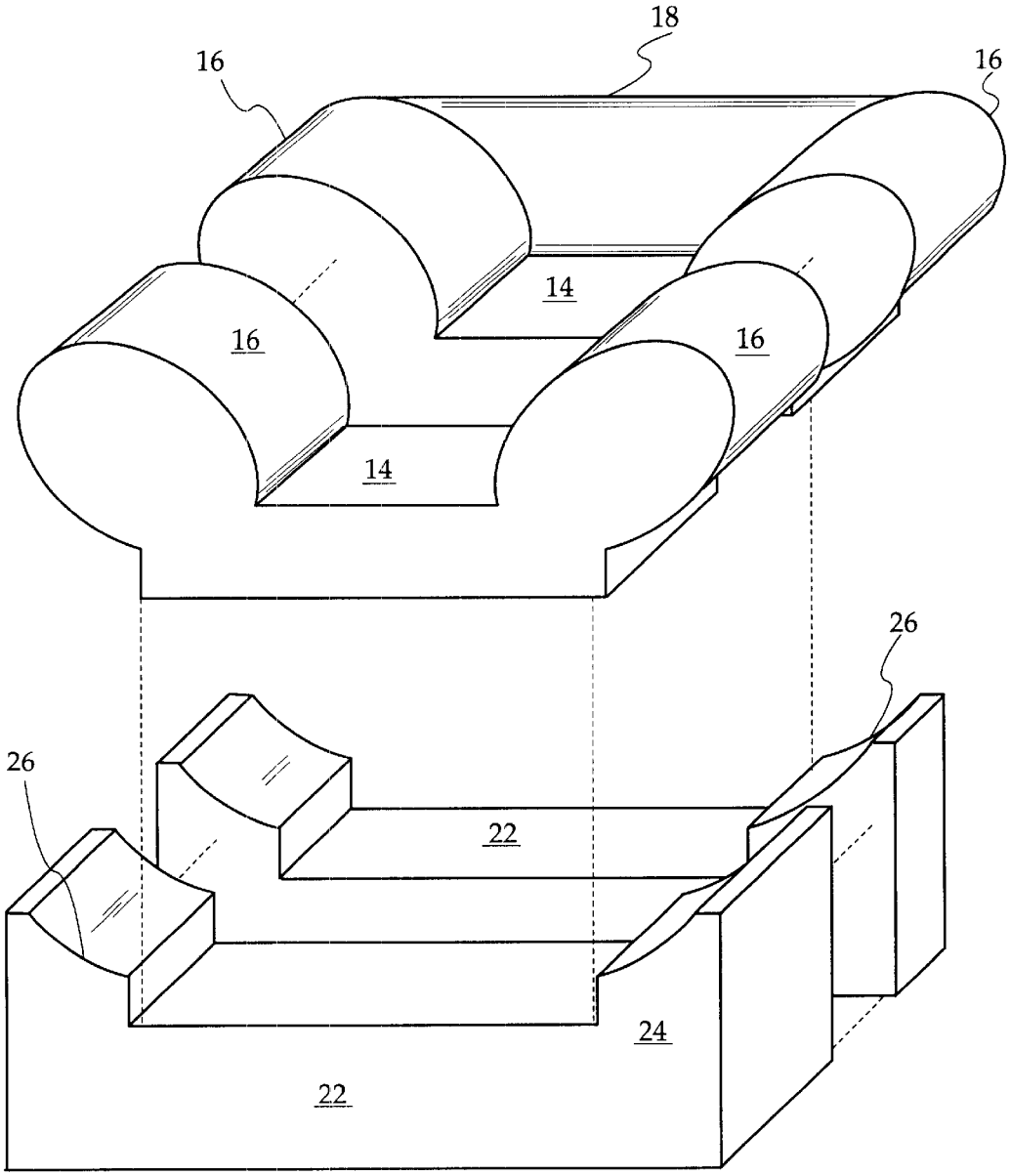
FIG. 3 is a fully exploded perspective view of the present invention.

With reference now to the drawings, and in particular, to FIGS. 1 through 5 thereof, the preferred embodiment of the new and improved modular chair embodying the principles and concepts of the present invention and generally designated by the reference number 10 will be described.

Specifically, it will be noted in the various figures that the device relates to a modular chair for being capable of being converted into a plurality of furniture components. In its broadest context, the device consists of a pair of upper components and a pair of lower components. Such components are individually configured and correlated with respect to each other so as to attain the desired objective.

The pair of upper components 12 each have a generally U-shaped configuration. Each upper component 12 has a horizontal segment 14 having opposed ends. The opposed ends each have a rounded segment 16 secured thereto and extending upwardly therefrom in an outwardly angular orientation. One of the upper components 12 has a back segment 18 extending between the rounded segments 16 thereof. The upper components 12 define the seated area when the device 10 is fully assembled. Note FIG. 1.

The pair of lower components 20 are adapted for coupling with the pair of upper components 12. In the fully assembled orientation, the lower components 20 define a base for being positioned on a recipient surface. The pair of lower components 20 each have a generally U-shaped configuration. Each lower component 20 has a horizontal segment 22 having opposed ends. The opposed ends each have a vertical segment 24 extending upwardly therefrom. Each vertical segment 24 has an arcuate recess 26 formed on upper and inner surfaces thereof. The pair of upper components 12 are receivable between the vertical segments 24 whereby the rounded segments 16 are seated within the arcuate recesses 26 and the horizontal segments 14,22 are in an abutting relationship in a fully assembled configuration. Note FIGS. 2 and 3. When in the fully assembled configuration, a slip cover can be positioned over the device 10 to prevent the inadvertent separation of the component's 12,20 from one another. The upper and lower components 12,20 can be separated from one another and inverted to provide four separate seats or benches. Note FIGS. 4 and 5. Alternately, the components 12,20 when inverted, could be used as a coffee, or end table.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A modular chair for being capable of being converted into a plurality of furniture components comprising, in combination:

a pair of upper components each having a generally U-shaped configuration, each upper component having a horizontal segment having opposed ends, the opposed ends each having a rounded segment secured thereto and extending upwardly therefrom in an outwardly angular orientation, one of the upper components having a back segment extending between the rounded segments thereof;

a pair of lower components adapted for coupling with the pair of upper components, the pair of lower components each having a generally U-shaped configuration, each lower component having a horizontal segment having opposed ends, the opposed ends each having a vertical segment extending upwardly therefrom, each vertical segment having an arcuate recess formed on upper and inner surfaces thereof, the pair of upper components being receivable between the vertical segments whereby the rounded segments are seated within the arcuate recesses and the horizontal segments in an abutting relationship in a fully assembled configuration; and wherein the upper and lower components can be separated from one another and inverted to provide four separate seats.

2. A modular chair for being capable of being converted into a plurality of furniture components comprising, in combination:

a pair of upper components each having a generally U-shaped configuration, each upper component having a horizontal segment having opposed ends, the opposed ends each having a rounded segment secured thereto and extending upwardly therefrom in an outwardly angular orientation;

a pair of lower components adapted for coupling with the pair of upper components, the pair of lower components each having a generally U-shaped configuration, each lower component having a horizontal segment having opposed ends, the opposed ends each having a vertical segment extending upwardly therefrom, each vertical segment having an arcuate recess formed on upper and inner surfaces thereof, the pair of upper components being receivable between the vertical segments whereby the rounded segments are seated within the arcuate recesses and the horizontal segments in an abutting relationship in a fully assembled configuration.

3. The modular chair as set forth in claim 2, wherein one of the upper components has a back segment extending between the rounded segments thereof.

4. The modular chair as set forth in claim 2, wherein the upper and lower components can be separated from one another and inverted to provide four separate seats.

* * * * *